US009169051B2

(12) United States Patent
Liu

(10) Patent No.: US 9,169,051 B2
(45) Date of Patent: Oct. 27, 2015

(54) PACKAGE FOR LOCK AND KEY

(71) Applicant: FEDERAL LOCK CO., LTD., Pingtung County (TW)

(72) Inventor: Tien-Kao Liu, Pingtung County (TW)

(73) Assignee: Federal Lock Co., Ltd., Pingtung County (TW)

( * ) Notice: Subject to any disclaimer, the term of this patent is extended or adjusted under 35 U.S.C. 154(b) by 119 days.

(21) Appl. No.: 14/075,160

(22) Filed: Nov. 8, 2013

(65) Prior Publication Data

US 2015/0129458 A1 May 14, 2015

(51) Int. Cl.
*B65D 73/00* (2006.01)

(52) U.S. Cl.
CPC ..... *B65D 73/0064* (2013.01); *B65D 73/0014* (2013.01)

(58) Field of Classification Search
CPC ..... B65D 73/0014; B65D 73/0035; B65D 43/0042
USPC ..... 206/580, 349, 461, 462, 481, 493, 806
See application file for complete search history.

(56) References Cited

U.S. PATENT DOCUMENTS

| | | | | |
|---|---|---|---|---|
| 3,251,465 | A * | 5/1966 | Winkhaus et al. | 206/580 |
| 5,906,350 | A * | 5/1999 | Kao | 248/688 |
| 7,516,843 | B2 * | 4/2009 | Konop et al. | 206/349 |
| 7,931,158 | B1 * | 4/2011 | Wu | 211/70.6 |

* cited by examiner

*Primary Examiner* — Steven A. Reynolds
*Assistant Examiner* — King M Chu
(74) *Attorney, Agent, or Firm* — Rosenberg, Klein & Lee

(57) ABSTRACT

A package includes a body with a key position and a lock position on one side thereof, and multiple positioning members on the other side of the body. The positioning members position a card. The body has at least one installation hole which has at least one contact portion. A hasp has at least one contact member. When the hasp extends through the at least one installation hole, the contact member is engaged with the at least one contact portion. The shackle of the lock is connected to the hasp and the hasp is adjustable relative to the installation hole according to the size of the lock. The body and hasp are modularized so as to be cooperated with different locks and reduce manufacturing cost.

9 Claims, 8 Drawing Sheets

PACKAGE FOR LOCK AND KEY

BACKGROUND OF THE INVENTION

1. Field of the Invention

The present invention relates to a package, and more particularly, to a package for accommodating a lock and a key for the lock.

2. Descriptions of Related Art

The conventional way to sell a lock usually has a package or a box in which the lock is received, and the package is designed to attract the consumers attentions and to protect the lock from being damaged during transportation. U.S. Pat. Nos. 7,743,917, 7,516,843 and 7,905,351 disclose a package for a lock which has a shackle. The package has a card with a front side and a back side, and the card has a positioning member which has a slot defined in the front side of the card. A bag has a room which extends from the front side of the card so as to accommodate the key of the lock. A locking member is used to secure the key in the bag.

For the three disclosures mentioned above, the shackle is hiked to the slot so as to connect the lock to the positioning member which is integrally formed on the front side of the card. Therefore, the positioning member cannot be adjustable relative to the card, so that the card can only be used for a certain type of lock. When a new type lock is to be displayed or packed, a new package has to be developed and manufactured, and this means new molds are needed and higher cost is involved. Besides, in order to restrict the lock to be rotated clockwise or counter clockwise, the lock is separated from the positioning member. However, there is an opening defined through the card and the lock is located corresponding to the opening, so that the lock swings horizontally and toward the card during transportation. When there are multiple locks connected to the positioning members are overlapped, the packages and/or the locks may be damaged by hit during transportation.

Another package for a lock is disclosed in FIG. 1 and comprises a card 10 which has a hasp 101 and a positioning portion 102 on the front side of the card 10. A hole 1011 is defined through the hasp 101 and two blocks 1021 are respectively located on two sides of the positioning portion 102. An opening 103 is defined in the lower end of the positioning portion 102. An accommodating portion 104 is formed in the card 10.

When in use, the shackle of the lock (not shown) is hooked to the hasp 101 via the hole 1011, and the positioning portion 102 is located to be enclosed by the shackle. The accommodating portion 104 accommodates the key for the lock. The card 10, the hasp 101 and the positioning portion 102 are integrally formed so that the height of the hasp 101 relative to the card 10 is fixed; The shape of the hasp 101 is also fixed, so that only the lock with the specific size of the shackle and lock can be used to the package. The package can only be used for certain type of lock, and a new package has to be developed when a different lock is to be packed. It takes time and has poor compatibility. Besides, when the shackle is hooked in the hasp 101, the opening 103 allows the lock to swing and this can hit other packages and locks during transportation.

The present invention intends to provide a package for a lock and a key, and the package improves the shortcomings mentioned above.

SUMMARY OF THE INVENTION

The present invention relates to a package and comprises a body having at least one installation hole which has at least one contact portion. A hasp has at least one contact member. When the hasp extends through the at least one installation hole, the contact member is engaged with the at least one contact portion.

Preferably, the hasp is connected with a shackle of a lock.

Preferably, the at least one contact portion is a block. The hasp has two ridges on two sides thereof and the at least one contact member is located between the two ridges. The at least one contact member is a recess.

Preferably, the body has a lock position and a key position formed therein.

Preferably, the lock position is a board.

Preferably, the key position is a room.

Preferably, the key position accommodates a key with a hole, and the key position has a slot. A strip extends through the hole and the slot to secure the key to the key position.

Preferably, the key position accommodates a key with a hole, and has an aperture. A pin extends through the hole and the aperture to secure the key to the key position.

Preferably, the body has multiple positioning members which position a card.

Preferably, the body has a hanging portion.

The primary object of the present invention is to provide a lock package, when the hasp extends through the at least one installation hole, the contact member is engaged with the at least one contact portion. The shackle of the lock is connected to the hasp. The hasp is adjustable relative to the installation hole according to the size of the lock. The lock position positions the lock which does not swing. The present invention has higher packing stability and the parts are modularized so as to reduce manufacturing cost and inventory pressure.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
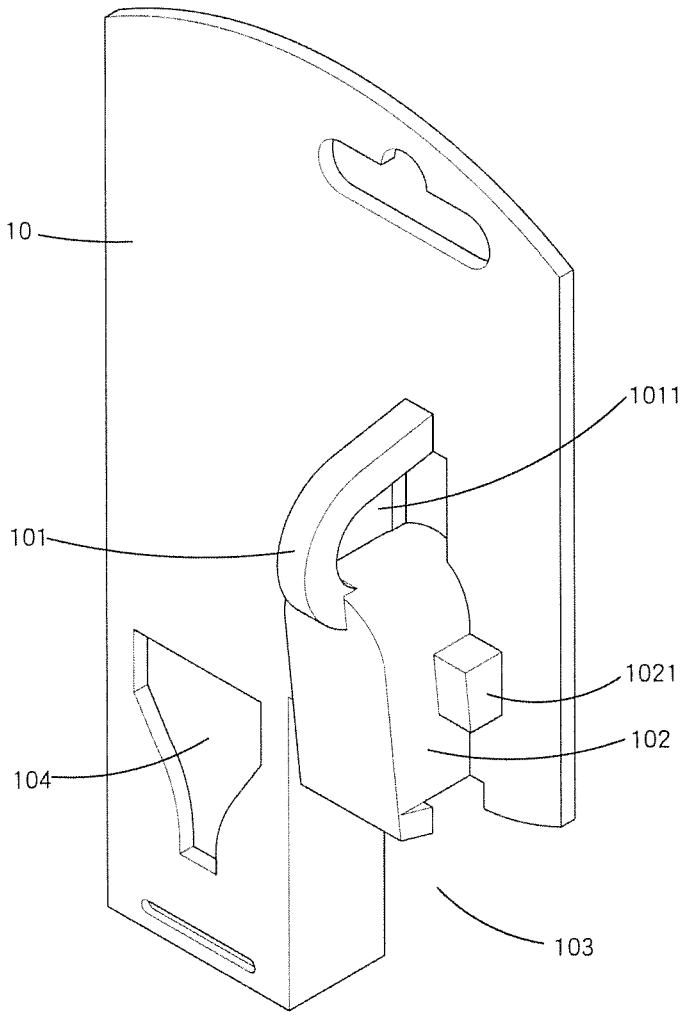
FIG.1(PRIOR ART)
FIG. 1 is a perspective view to show the conventional lock package.
Figure 2:
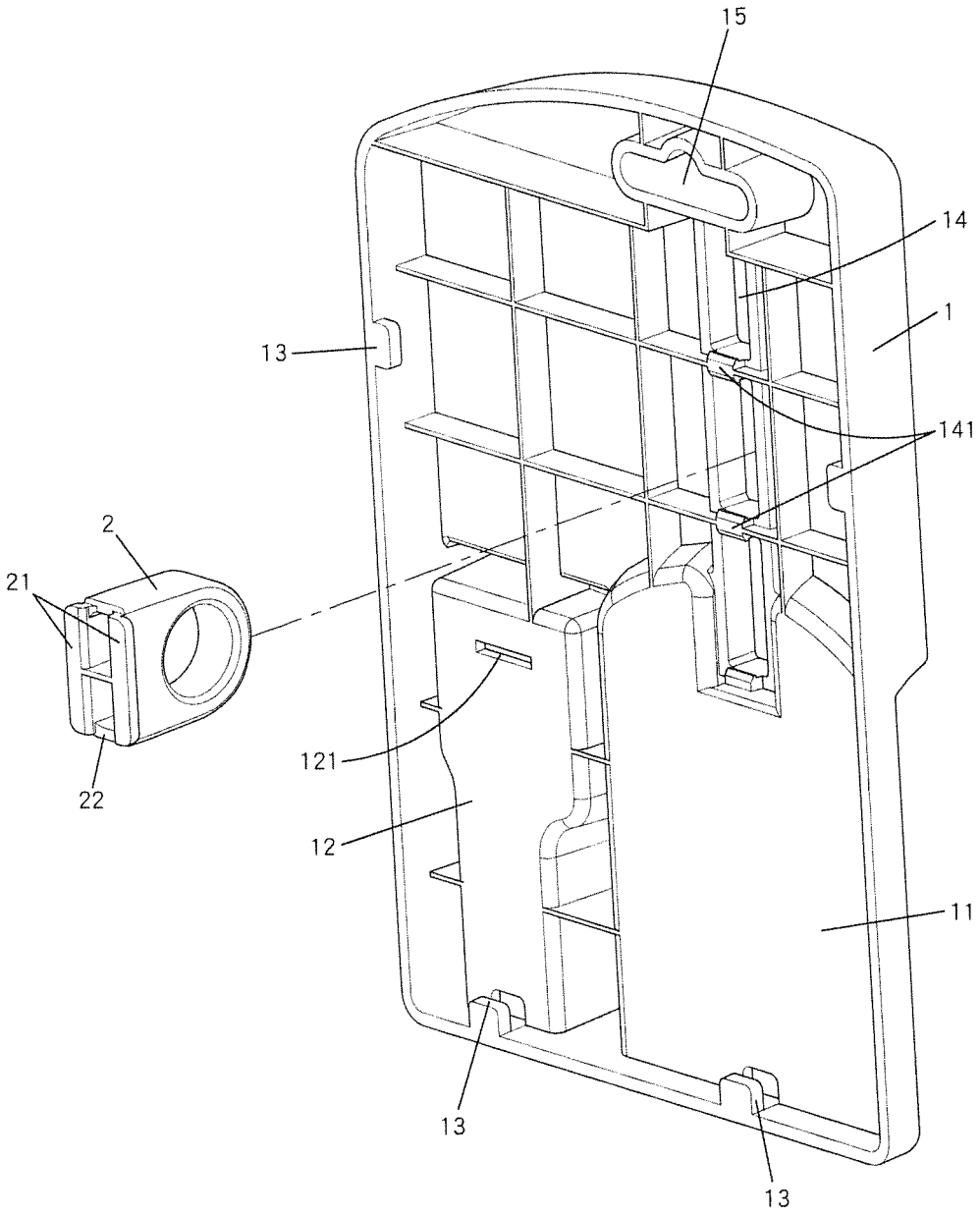
FIG. 2 is an exploded view of the package of the present invention.
Figure 3:
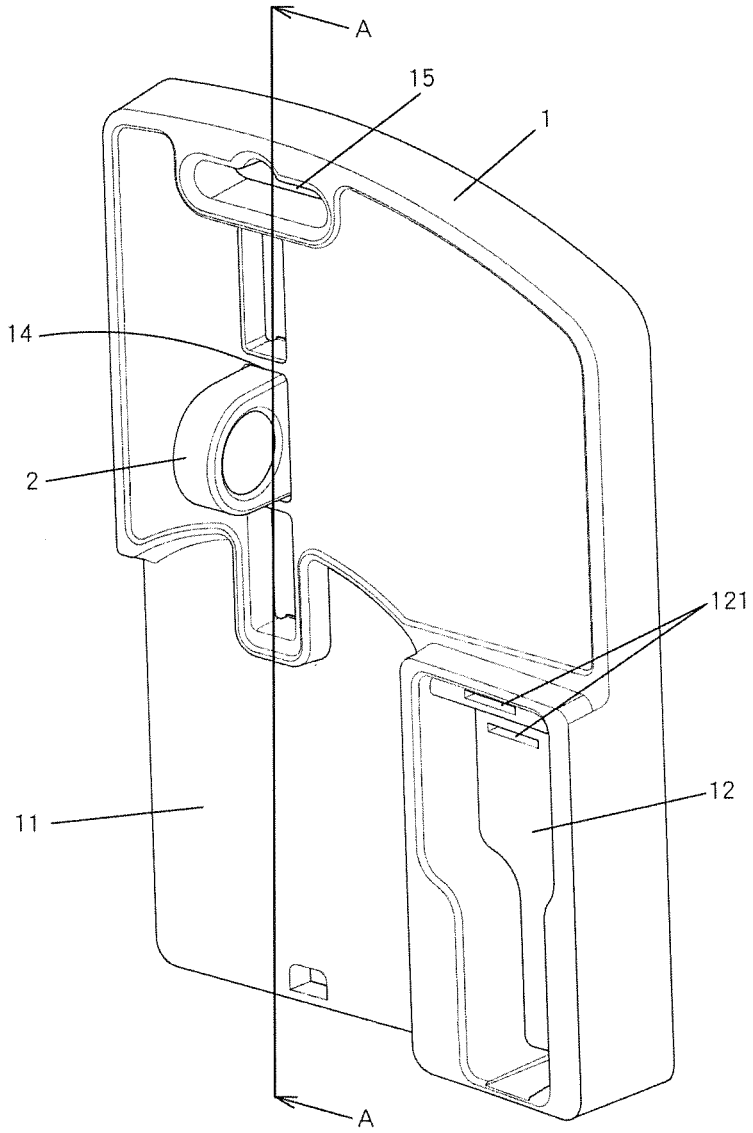
FIG. 3 is a perspective view to show the package of the present invention.

Referring to FIGS. 2 and 3, the package of the present invention comprises a body 1 having a lock position 11 and a key position 12 formed therein. The lock position 11 is a board (or flat portion) and the key position 12 is a room. The body 1 has multiple positioning members 13 extending from two insides thereof. The body 1 has at least one installation hole 14 which has at least one contact portion 141, in this embodiment, the at least one contact portion 141 is a block. The body 1 has a hanging portion 15.

A hasp 2 has two ridges 21 on two sides thereof and at least one contact member 22 is located between the two ridges 21. The at least one contact member 22 is a recess.

Figure 4:
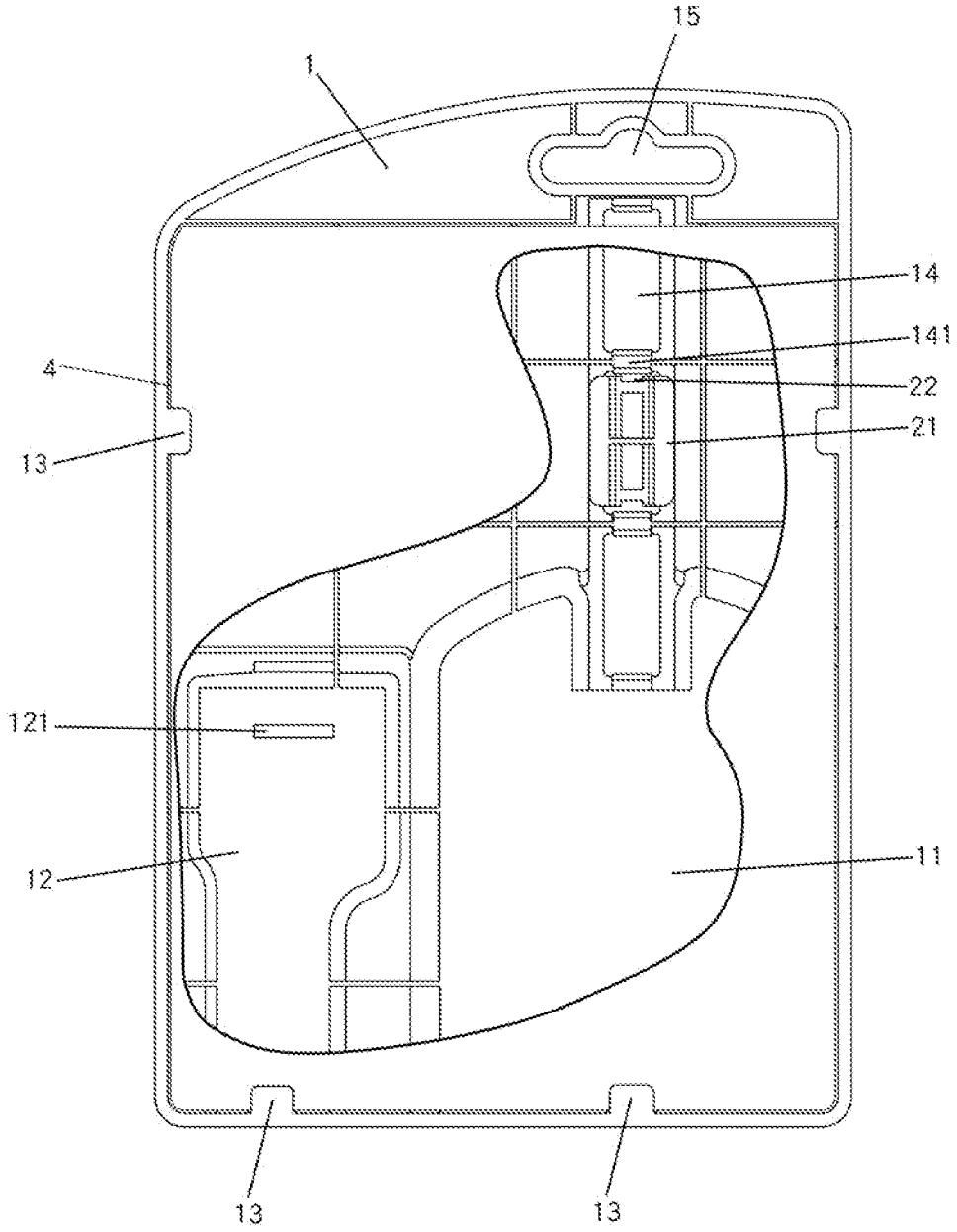
FIG. 4 shows the back side of the package of the present invention.
Figure 5:
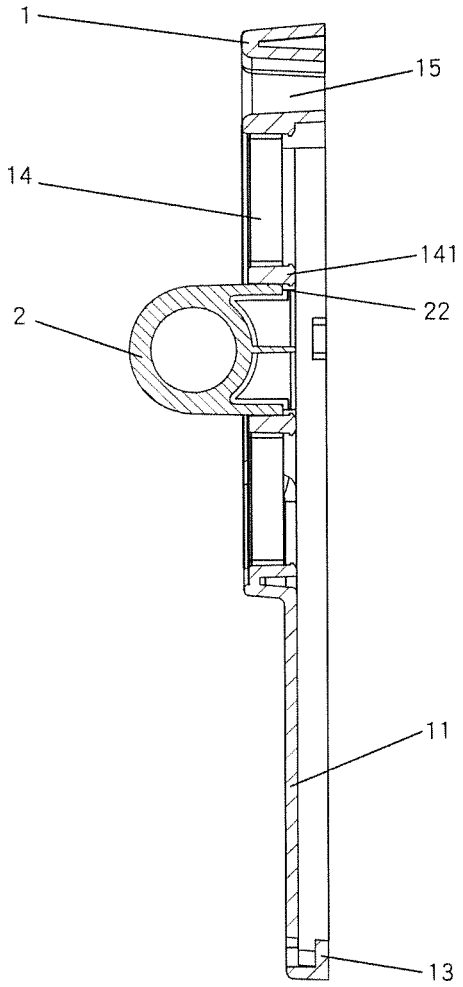
FIG. 5 is a cross sectional view, taken along line A-A in FIG. 3.
Figure 6:
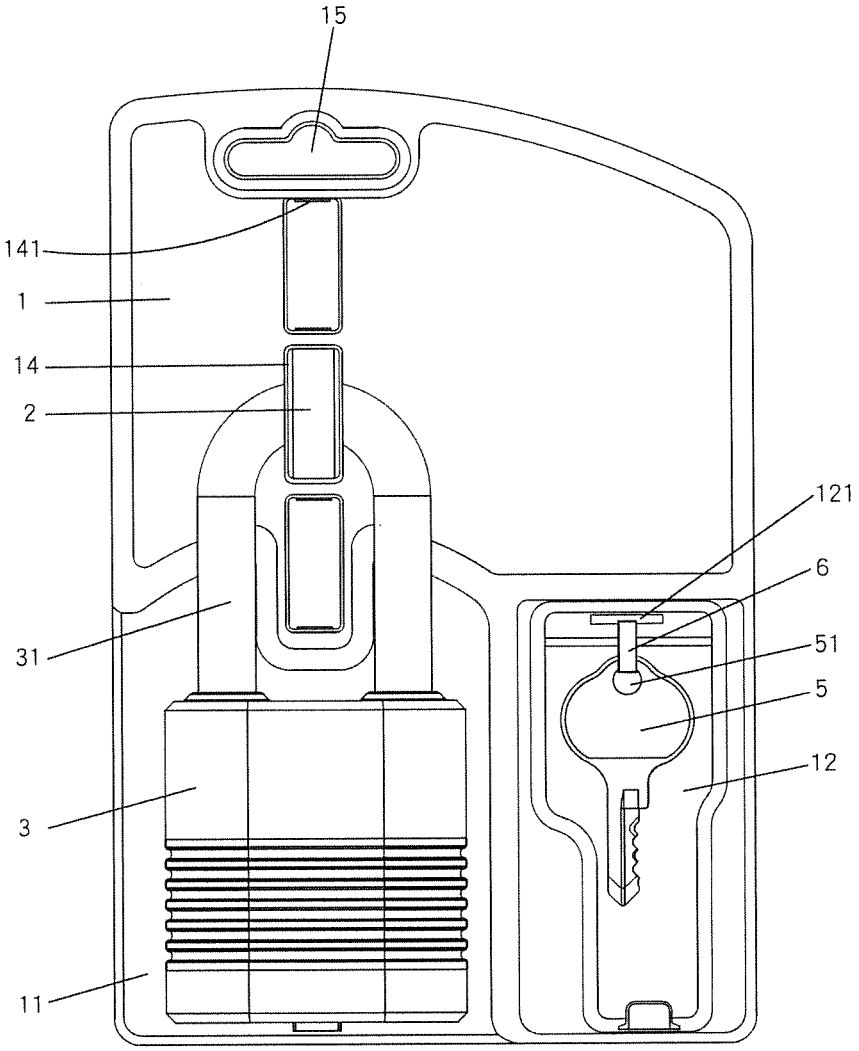
FIG. 6 shows a lock is packed with the package of the present invention.

As shown in FIGS. 4 to 6, the hasp 2 is connected with the installation hole 14 according to the size of the lock. In this embodiment, there are three installation holes 14, the hasp 2 is connected to one of the installation holes 14, the contact members 22 are engaged with the contact portions 141 of the installation hole 14. In other words, the blocks are engaged with recess between the ridges 21 and located at the ends of the ridges 21 to secure the hasp 2 relative to the installation hole 14. The shackle 31 of the lock 3 is connected to the hasp 2, and the lock 3 is located at the lock position 11 which is a board so as to stably position the lock 3 relative to the body 1. As shown in FIG. 4, the positioning members 13 position a card 4 which displays the specification of the lock and may include bar codes and instructions. The key position 12 accommodates a key 51 with a hole 51. The key position 12 has a slot 121. A strip 6 extends through the hole 51 and the slot 121 to secure the key 5 to the key position 12. When another lock 3 having different size is to be packed, the hasp 2 is optionally connected with different installation holes 14 so that the hasp 2 is located at desired height relative to the installation hole 14 to pack the lock 3 as shown in FIG. 7.

Figure 7:
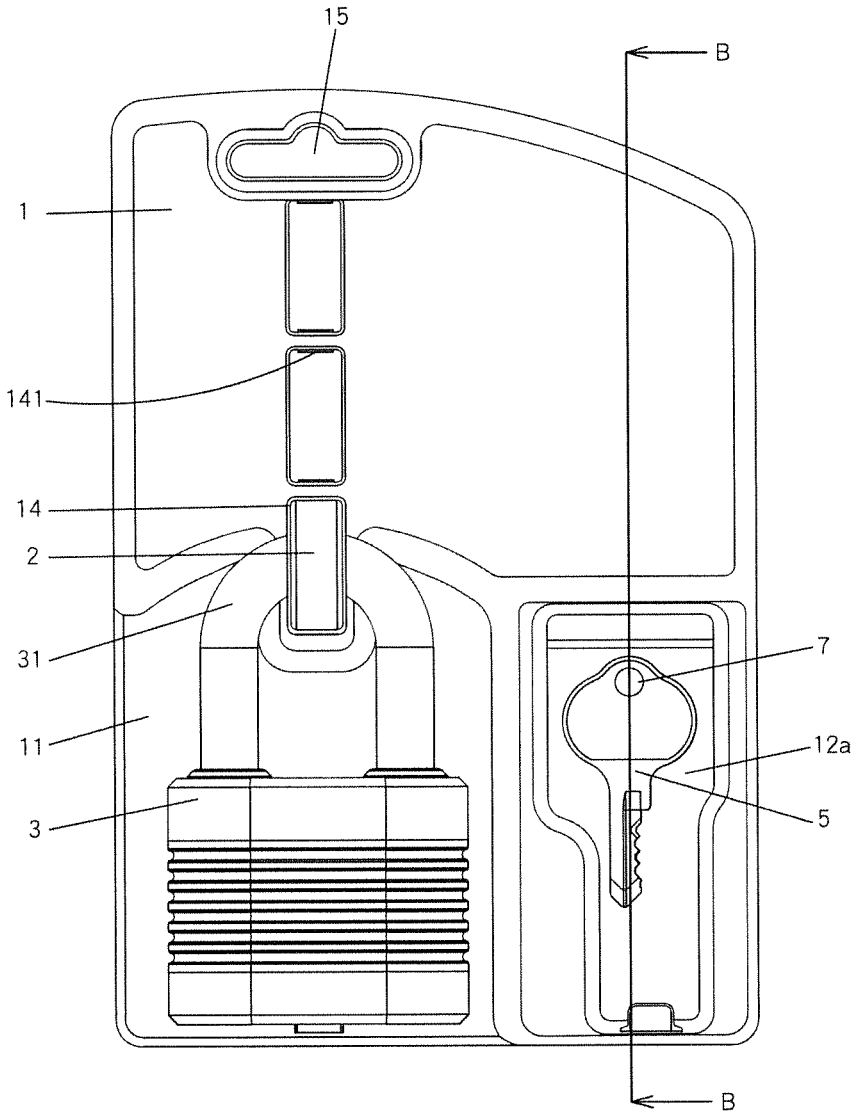
FIG. 7 shows another lock is packed with the package of the present invention.
Figure 8:
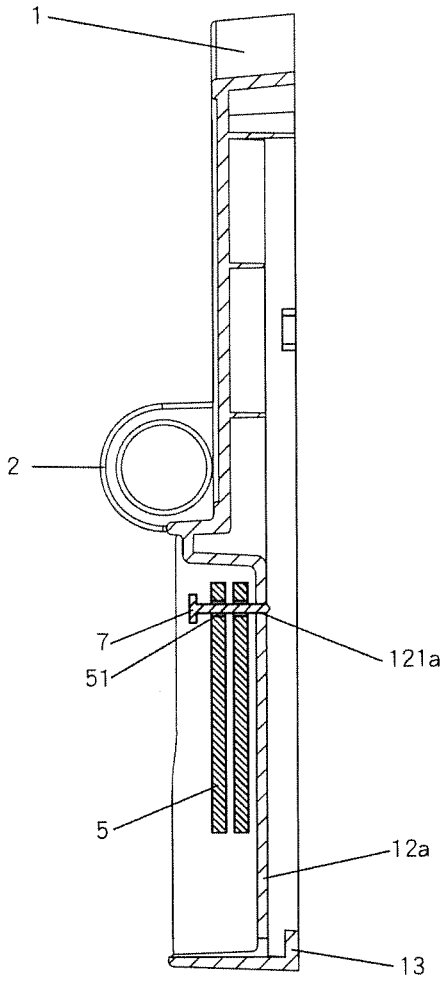
FIG. 8 is a cross sectional view, taken along line B-B in FIG. 7.

As shown in FIGS. 7 and 8, the key position 12*a* is different from that in the previous embodiment, wherein the key position 12*a* has an aperture 121*a*, and a pin 7 extends through the hole 51 and the aperture 121*a* to secure the key 5 to the key position 12*a*.

The present invention provides a lock package with adjustable hasp 2 relative to the body 1 so that the position or height of the hasp 2 can be adjusted according to the shackle 31 of the lock 3. There are multiple installation holes 14 which are modularized to meet different locks 3 so that the range of use of the package is improved. Besides, the lock position 11 positions the lock 3 connected to the hasp 2 to prevent swinging of the lock 3 during transportation. The key 5 can be secured to the key position 12, 12*a* by using the strip 6 or the pin 7. The present invention has higher packing stability and the parts are modularized so as to reduce manufacturing cost and inventory pressure.

While we have shown and described the embodiment in accordance with the present invention, it should be clear to those skilled in the art that further embodiments may be made without departing from the scope of the present invention.

What is claimed is:

1. A package comprising:

a body having at least one installation hole which has at least one contact portion, and a hasp having at least one contact member, the hasp extending through the at least one installation hole, the contact member engaged with the at least one contact portion;

wherein the at least one contact portion is a block, the hasp has two ridges on two sides thereof and the at least one contact member is located between the two ridges, the at least one contact member is a recess.

2. The package as claimed in claim 1, wherein the hasp is connected with a shackle of a lock.

3. The package as claimed in claim 1, wherein the body has a lock position and a key position is formed therein.

4. The package as claimed in claim 3, wherein the lock position is a board.

5. The package as claimed in claim 3, wherein the key position is a room.

6. The package as claimed in claim 3, wherein the key position accommodates a key with a hole, the key position has a slot, a strip extends through the hole and the slot to secure the key to the key position.

7. The package as claimed in claim 3, wherein the key position accommodates a key with a hole, the key position has an aperture, a pin extends through the hole and the aperture to secure the key to the key position.

8. The package as claimed in claim 1, wherein the body has multiple positioning members which position a card.

9. The package as claimed in claim 1, wherein the body has a hanging portion.

* * * * *